US008723882B2

(12) United States Patent
Wang

(10) Patent No.: US 8,723,882 B2
(45) Date of Patent: May 13, 2014

(54) DITHERING MASK AND METHOD OF FORMING THE SAME

(75) Inventor: Shih-Chung Wang, Hsin-Chu (TW)

(73) Assignee: MStar Semiconductor, Inc., ChuPei, Hsin-Chu Hsien (TW)

( * ) Notice: Subject to any disclaimer, the term of this patent is extended or adjusted under 35 U.S.C. 154(b) by 814 days.

(21) Appl. No.: 12/237,406

(22) Filed: Sep. 25, 2008

(65) Prior Publication Data

US 2009/0085925 A1 Apr. 2, 2009

(30) Foreign Application Priority Data

Sep. 28, 2007 (TW) ..... 96136168 A

(51) Int. Cl.
*G09G 5/02* (2006.01)

(52) U.S. Cl.
USPC ..... 345/596; 358/3.06; 358/3.07; 358/3.08; 358/3.09; 358/3.1; 358/3.13; 358/3.16

(58) Field of Classification Search
USPC ..... 345/596; 358/3.06–3.09, 3.1, 3.13, 3.16
See application file for complete search history.

(56) References Cited

U.S. PATENT DOCUMENTS

| | | | | |
|---|---|---|---|---|
| 4,517,605 | A * | 5/1985 | Yokomizo | 358/3.13 |
| 7,110,010 | B1 | 9/2006 | Masuji | |
| 7,710,440 | B2 * | 5/2010 | Masuji et al. | 345/690 |
| 7,924,465 | B2 * | 4/2011 | Ike et al. | 358/3.06 |
| 2005/0248583 | A1 * | 11/2005 | Gotoda | 345/596 |
| 2006/0256100 | A1 | 11/2006 | Masuji | |
| 2007/0279432 | A1 * | 12/2007 | Noel et al. | 345/596 |
| 2009/0066716 | A1 * | 3/2009 | Meulen | 345/589 |
| 2010/0231631 | A1 * | 9/2010 | Hosaka | 347/15 |

FOREIGN PATENT DOCUMENTS

CN 1627349 A 6/2005

* cited by examiner

*Primary Examiner* — Ke Xiao
*Assistant Examiner* — Kim-Thanh T Tran
(74) *Attorney, Agent, or Firm* — Winston Hsu; Scott Margo

(57) ABSTRACT

A method of forming a dithering mask includes providing a specific sub-dithering mask, and generating a plurality of sub-dithering masks of the dithering mask by adjusting the specific sub-dithering mask. The dithering mask generated by the method includes a plurality of sub-dithering masks, each sub-dithering mask includes (4N)×(4N) dithering values, where N is an integer, and at least two sub-dithering masks of the plurality of sub-dithering masks have different contents. By breaking the regularity in the dithering mask, flickering patterns or visual patterns can be avoided on the screen, thereby raising the displaying quality of the screen.

4 Claims, 3 Drawing Sheets

DITHERING MASK AND METHOD OF FORMING THE SAME

BACKGROUND OF THE INVENTION

1. Field of the Invention

The present invention relates to a dithering mask used in displaying images and a method of forming the same, and more particularly, to a dithering mask that can avoid generating flick patterns on a screen, and a method of forming the dithering mask.

2. Description of the Prior Art

Dithering, which is a technique to display halftone, places pixels with two gray levels in specific positions to create the visional illusion in human eyes that a third gray level between the two gray levels is present, thereby achieving a dithering effect in the space domain. Another way to obtain the dithering effect is in the time domain by rotating a dithering mask so that points in the dithering mask switch rapidly between different gray levels.

The above-mentioned dithering techniques, however, may generate flick patterns or unexpected patterns (such as a particularly bright line or a rolling bright line) on the screen in some situations. For example, please refer to FIG. 1A-FIG. 1D. As shown in FIG. 1A, the screen only regularly displays two pixels of four adjacent pixels (the pixels not displayed are shown with oblique lines in FIG. 1A; that is, the contents of the pixels 130 and 140 are shown in the display screen, while the contents of the pixels 110 and 120 are not shown), and the dithering result is that the pixels 130, 150, 160 and 170 have a higher gray level A, and the other pixels have a lower gray level B. After being processed by the above-mentioned time domain rotation as shown in FIG. 1B, the pixels having higher gray level A are all rotated to the non-displayed positions. Therefore, the illumination of the screen in FIG. 1B becomes darker than the preceding screen, i.e., the screen in FIG. 1A. Next, when the screen in FIG. 1B is rotated, generating screen in FIG. 1C, and the screen in FIG. 1C is further rotated to generate screen in FIG. 1D, the illumination of the screen in FIG. 1D is brighter than the preceding screen since the pixels having the higher gray level A are rotated back to the display positions. The variation of the illumination of the display screen causes a flicker phenomenon noticeable to human eyes, and deteriorates the display quality of the screen.

SUMMARY OF THE INVENTION

One objective of the present invention is therefore to provide a dithering mask that can avoid generating flick patterns on a screen, and a method of forming the dithering mask, to solve the above problems.

According to one exemplary embodiment of the present invention, a method of generating a dithering mask used in displaying images is provided. The dithering mask comprises a plurality of sub-dithering masks. The method includes providing a specific sub-dithering mask, and generating the plurality of sub-dithering masks of the dithering mask, wherein each of the plurality of sub-dithering masks is generated by adjusting the specific sub-dithering mask.

According to another exemplary embodiment of the present invention, a dithering mask used in displaying images is provided. The dithering mask includes a plurality of sub-dithering masks, and each sub-dithering mask includes (4N)×(4N) dithering values, where N is a positive integer. At least two sub-dithering masks of the plurality of sub-dithering masks have different contents, which are formed by adjusting a specific sub-dithering mask.

These and other objectives of the present invention will no doubt become obvious to those of ordinary skill in the art after reading the following detailed description of the preferred embodiment that is illustrated in the various figures and drawings.

DETAILED DESCRIPTION

In order to avoid flickering patterns or unexpected patterns generating on the screen, the regularity in a dithering mask is broken to form a novel dithering mask. In this way, the problems of the prior arts can be solved without altering the dithered color tones.

Figure 1A:
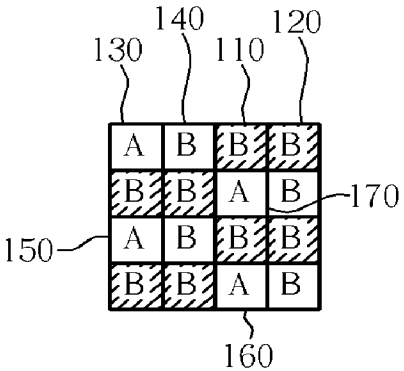
FIG. 1A to FIG. 1D show diagrams of a display screen at different times during a conventional dithering process.
Figure 1B:
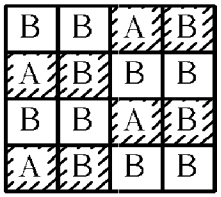
Figure 1C:
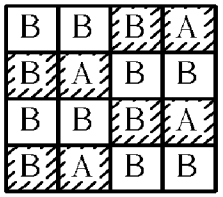
Figure 1D:
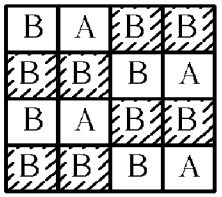
Figure 2:
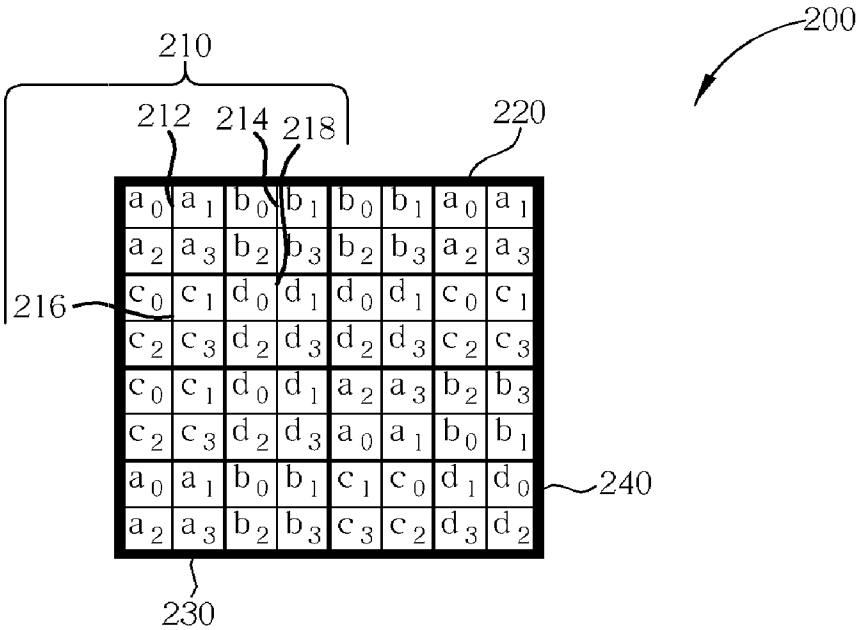
FIG. 2 is a diagram of a dithering mask according to an exemplary embodiment of the present invention.

Please refer to FIG. 2, which is a diagram of a dithering mask according to an exemplary embodiment of the present invention. As shown in FIG. 2, the dithering mask 200 is an 8×8 matrix, including four 4×4 sub-dithering masks 210, 220, 230 and 240. Each sub-dithering mask includes four 2×2 dithering mask units 212, 214, 216 and 218, and each dithering mask unit includes 4 dithering values; for example, the dithering mask unit 212 includes dithering values $a_0$, $a_1$, $a_2$, and $a_3$, and the dithering mask unit 214 includes dithering values $b_0$, $b_1$, $b_2$, and $b_3$. As can be seen, the sub-dithering masks 220, 230 and 240 are formed by adjusting the sub-dithering mask 210, and the adjusting method includes exchanging positions of two dithering mask units in a same row (the sub-dithering mask 220 is generated for an exemplary embodiment), exchanging positions of two dithering mask units in a same column (the sub-dithering mask 230 is generated for an exemplary embodiment), adjusting the arrangement of the dithering values in the dithering mask unit(s) (the sub-dithering mask 240 is generated for an exemplary embodiment), and combinations of the above methods. More specifically, the sub-dithering mask 220 is formed by exchanging positions of the dithering mask units 212 and 214 in the sub-dithering mask 210, and exchanging positions of the dithering mask units 216 and 218, but not changing the contents of each dithering mask unit; the sub-dithering mask 230 is formed by exchanging positions of the dithering mask units 212 and 216 in the sub-dithering mask 210, and exchanging positions of the dithering mask units 214 and 218, but not changing contents of the dithering mask units; the sub-dithering mask 240 is formed by not changing positions of the dithering mask units in the sub-dithering mask 210, but adjusting the arrangements of the dithering values in the dithering mask units.

Figure 3:
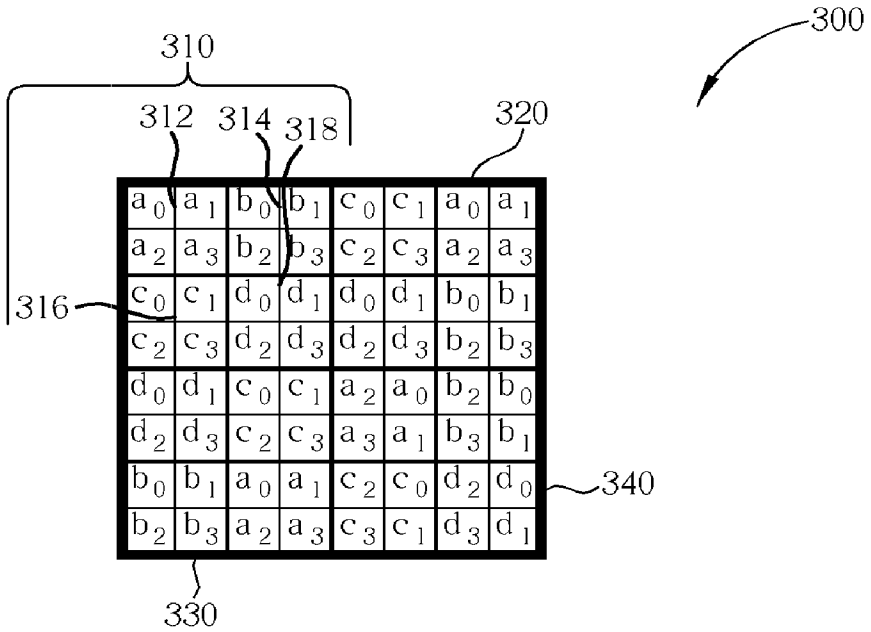
FIG. 3 is a diagram of a dithering mask according to another exemplary embodiment of the present invention.

FIG. 3 is a diagram of a dithering mask according to another exemplary embodiment of the present invention. The dithering mask 300 also includes four 4×4 sub-dithering masks 310, 320, 330 and 340. Each sub-dithering mask includes four 2×2 dithering mask units 312, 314, 316 and 318, and each dithering mask unit includes 4 dithering values. In this embodiment, the sub-dithering masks can be generated by rotating a specific sub-dithering mask. For example, the sub-dithering masks 320 and 330 are formed by rotating the dithering mask units in the sub-dithering mask 310 clockwise by a specific angle; the sub-dithering mask 340 is formed by rotating the dithering values in the dithering mask units 312,

314, 316 and 318 in the sub-dithering mask 310. Therefore, the present embodiment can be regarded as a combination of the time domain dithering and the space domain dithering.

In the above embodiments, the provided adjusting methods include adjusting positions of at least two dithering mask units or dithering values, rotating a plurality of dithering mask units or the dithering values, and the combination of the above methods. When implemented, the provided adjusting methods can be simply achieved by exclusive OR (XOR) logic computations. Please note that the specific sub-dithering mask utilized as a basis of adjustment is not limited to the sub-dithering mask 210(310). Other sub-dithering masks, such as the sub-dithering mask 220(320) can be utilized as the specific sub-dithering mask, and in this situation, the sub-dithering masks 210(310), 230(330), and 240(340) are formed by adjusting the sub-dithering mask 220(320). Moreover, the present invention is not limited to use a single specific sub-dithering mask as the adjustment basis, and the sub-dithering masks are not necessary to all be different.

Conventionally, a dithering mask is generated by repeatedly arranging a same sub-dithering mask consisting of 4×4 dithering values. However, as disclosed above, the method of generating a dithering mask provided in the present invention makes the regularity in the dithering mask disappear or decrease. Note that although the above embodiments all take 8×8 dithering masks as examples, it is not a limitation of the present invention. The dithering masks can be a 12×12 matrix, a 16×16 matrix, a 20×20 matrix and so on. As long as the sub-dithering masks of the dithering mask respectively include (4N)×(4N) dithering values, where N is a positive integer, and at least two sub-dithering mask of the dithering mask have different contents, the dithering mask belongs to the scope of the present invention. Since the regularity in the dithering mask is broken, the dithering mask can effectively avoid generating flickering patterns or unexpected patterns on the screen, while keep predetermined dithering effect.

Those skilled in the art will readily observe that numerous modifications and alterations of the device and method may be made while retaining the teachings of the invention.

What is claimed is:

1. A method of forming a dithering mask used in displaying images on a screen, wherein the dithering mask comprises a plurality of sub-dithering masks, the method comprising:

providing a specific sub-dithering mask; and generating the plurality of sub-dithering masks of the dithering mask, wherein each of the plurality of sub-dithering masks is generated by adjusting the specific sub-dithering mask;

wherein a size of the specific sub-dithering mask is equal to a size of each of the plurality of sub-dithering masks; the specific sub-dithering mask comprises a plurality of dithering mask units, each dithering mask unit comprises a plurality of dithering values, and the step of generating two sub-dithering masks among the plurality of sub-dithering masks of the dithering mask comprises: rotating the plurality of dithering values clockwise in space domain to adjust positions of at least two dithering values among the plurality of dithering values so as to form one sub-dithering mask, and rotating the plurality of dithering mask units clockwise by a specific angle in space domain to adjust positions of at least two dithering mask units among the plurality of dithering mask units so as to form the other sub-dithering mask; and, all the sub-dithering masks are respectively formed by identical dithering values.

2. The method of claim 1, wherein at least two sub-dithering masks of the plurality of sub-dithering masks have different contents.

3. The method of claim 1, wherein the step of generating the plurality of sub-dithering masks of the dithering mask comprises:

rotating positions of units comprised within the specific sub-dithering mask.

4. The method of claim 1, wherein the specific sub-dithering mask comprises four dithering mask units, and each dithering mask unit comprises four dithering values.

* * * * *